US009146031B2

(12) United States Patent
Scott et al.

(10) Patent No.: US 9,146,031 B2
(45) Date of Patent: Sep. 29, 2015

(54) LIGHTING MODULE

(71) Applicant: BRIDGELUX, INC., Livermore, CA (US)

(72) Inventors: Keith Scott, Livermore, CA (US); Todd Farmer, Livermore, CA (US)

(73) Assignee: BRIDGELUX, INC., Livermore, CA (US)

( * ) Notice: Subject to any disclaimer, the term of this patent is extended or adjusted under 35 U.S.C. 154(b) by 190 days.

(21) Appl. No.: 13/862,337

(22) Filed: Apr. 12, 2013

(65) Prior Publication Data

US 2014/0140065 A1 May 22, 2014

Related U.S. Application Data

(60) Provisional application No. 61/624,221, filed on Apr. 13, 2012.

(51) Int. Cl.

| | |
|---|---|
| ***F21V 29/74*** | (2015.01) |
| ***F21V 29/00*** | (2015.01) |
| ***F21S 8/08*** | (2006.01) |
| ***F21V 13/04*** | (2006.01) |
| ***F21V 29/76*** | (2015.01) |
| ***F21V 29/78*** | (2015.01) |
| ***F21V 29/83*** | (2015.01) |
| *F21V 5/00* | (2015.01) |
| *F21V 7/00* | (2006.01) |
| *F21Y 101/02* | (2006.01) |
| *F21Y 105/00* | (2006.01) |

(52) U.S. Cl.

CPC ..... *F21V 29/2293* (2013.01); *F21S 8/086* (2013.01); *F21V 13/04* (2013.01); *F21V 29/74* (2015.01); *F21V 29/763* (2015.01); *F21V 29/78* (2015.01); *F21V 29/83* (2015.01); *F21V 5/00* (2013.01); *F21V 7/00* (2013.01); *F21Y 2101/02* (2013.01); *F21Y 2105/001* (2013.01)

(58) Field of Classification Search

CPC ..... F21S 8/086; F21V 29/78; F21V 29/745; F21V 29/70

USPC ..... 362/294, 373, 431, 249.02

See application file for complete search history.

(56) References Cited

U.S. PATENT DOCUMENTS

| | | | | |
|---|---|---|---|---|
| 8,167,466 | B2 * | 5/2012 | Liu | 362/373 |
| 8,602,601 | B2 * | 12/2013 | Khazi et al. | 362/297 |
| 8,684,565 | B2 * | 4/2014 | Lopez et al. | 362/294 |
| 8,702,278 | B2 * | 4/2014 | Wang et al. | 362/294 |
| 2010/0259935 | A1 * | 10/2010 | Scordino et al. | 362/294 |
| 2011/0110095 | A1 * | 5/2011 | Li et al. | 362/294 |
| 2011/0273881 | A1 * | 11/2011 | Domagala et al. | 362/235 |

* cited by examiner

*Primary Examiner* — Peggy Neils
(74) *Attorney, Agent, or Firm* — Arent Fox LLP

(57) ABSTRACT

A street light may include a pole and a head attached to the pole. The head may include a lighting module. The lighting module may include a light-emitting device configured to emit light, a thermal interface configured to conduct heat away from the light-emitting device, an optical element configured to transmit the emitted light in a light distribution pattern on an area located a distance away from the lighting module, and a reflective surface configured to redirect a portion of the light transmitted by the optical element.

19 Claims, 10 Drawing Sheets

LIGHTING MODULE

CROSS-REFERENCE TO RELATED APPLICATIONS

This application claims the benefit and right of priority under 35 U.S.C. 119 to Provisional U.S. Patent Application No. 61/624,221, which was filed on Apr. 13, 2012.

BACKGROUND

The present disclosure relates to light sources and, more particularly, to a lighting module.

A light-emitting device, such as a light-emitting diode (LED), is an attractive candidate for replacing conventional light sources such as incandescent, halogen and fluorescent lights. LEDs have substantially higher light conversion efficiencies than incandescent and halogen lights and longer lifetimes than these types of conventional light sources. Some types of LEDs have higher conversion efficiencies than fluorescent light sources. LEDs require lower voltages than fluorescent lights and contain no mercury or other dangerous materials. Some light-emitting devices have been used to replace high-intensity discharge (HID) lights to provide high levels of light over large areas that require greater energy efficiency or light intensity. Such areas include roadways, parking lots, pathways, large public areas, and other outdoor applications.

SUMMARY

In one aspect of the present disclosure, A lighting module includes a light-emitting device configured to emit light, a thermal interface configured to conduct heat away from the light-emitting device, an optical element configured to transmit the emitted light in a light distribution pattern on an area located a distance away from the lighting module, and a reflective surface configured to redirect a portion of the light transmitted by the optical element.

It is understood that other aspects of apparatuses and methods will become readily apparent to those skilled in the art from the following detailed description, wherein various aspects of apparatuses and methods are shown and described by way of illustration. As will be realized, these aspects may be implemented in other and different forms and its several details are capable of modification in various other respects. Accordingly, the drawings and detailed description are to be regarded as illustrative in nature and not as restrictive.

BRIEF DESCRIPTION OF THE FIGURES

Various aspects of apparatuses and methods will now be presented in the detailed description by way of example, and not by way of limitation, with reference to the accompanying drawings, wherein.

DETAILED DESCRIPTION

Figure 1:
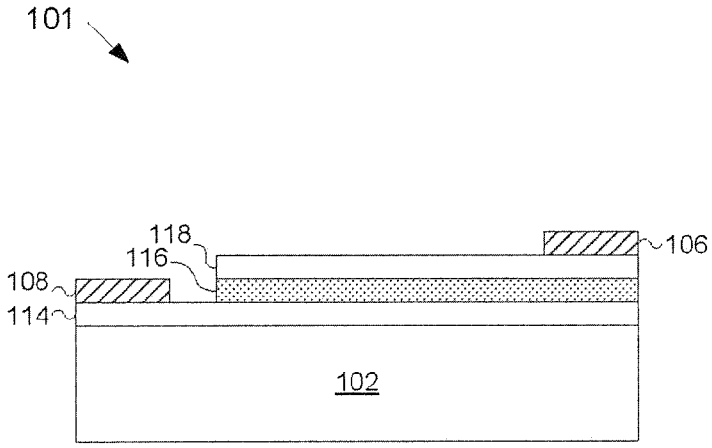
FIG. 1 is a cross-sectional illustration of an example light-emitting device.

Various aspects of the disclosure will be described more fully hereinafter with reference to the accompanying drawings. This disclosure may, however, be embodied in many different forms by those skilled in the art and should not be construed as limited to any specific structure or function presented herein. Rather, these aspects are provided so that this disclosure will be thorough and complete, and will fully convey the scope of the disclosure to those skilled in the art. Based on the teachings herein, one skilled in the art should appreciate that the scope of the disclosure is intended to cover any aspect of this disclosure, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure and/or functionality in addition to or instead of other aspects of this disclosure. It should be understood that any aspect of the disclosure disclosed herein may be embodied by one or more elements of a claim.

Disclosed is an apparatus that may be used for retrofitting a conventional lighting system, such as a street light. In one example, a street light may have a head including a light source comprising one or more light-emitting devices, an optical element, and one or more reflectors configured to reflect light emitted by the one or more light-emitting devices to the optical element to produce a light distribution pattern from the head. The one or more light-emitting devices may produce Lambertia light, such that an observer perceives a constant brightness across the one or more light-emitting devices. The light produced by the light-emitting devices may be used to illuminate a reflector. The reflector may be used to transform the Lambertia light to collimated light and direct the collimated light towards the optical element. The optical element may be configured to produce the light distribution pattern from the collimated light.

By way of example, "street light" may refer to any lighting system that provides any illumination to a street, road, walkway, tunnel, park, outdoor facility, parking lot, or the like. A "pole" may refer to any structure for supporting a lighting system, such as a light post, hi-bay support, wall mounting, suspended hanging fixture, support frame, ceiling mount, or the like. A "thermal management system" may comprise at least a heat sink, heat spreader, heat fin, heat pipe, thermal interface material, active air movement devices, or the like.

An example of a light-emitting device is an LED. An LED is a semiconductor material impregnated, or doped, with impurities. These impurities add "electrons" and "holes" to the semiconductor, which can move in the material relatively freely. Depending on the kind of impurity, a doped region of the semiconductor can have predominantly electrons or holes, referred to as an n-type or p-type semiconductor region, respectively. In LED applications, the semiconductor includes an n-type semiconductor region and a p-type semiconductor region. A reverse electric field is created at the junction between the two regions, which causes the electrons and holes to move away from the junction and towards an active region. When a forward voltage sufficient to overcome the reverse electric field is applied across the p-n junction, electrons and holes are forced into the active region and combine. When electrons combine with holes, they fall to lower energy levels and release energy in the form of light.

FIG. 1 is a cross-sectional illustration of an example LED. The LED 101 includes a substrate 102, an epitaxial-layer structure formed on the substrate 102, and a pair of electrodes 106, 108 on the epitaxial-layer structure. The epitaxial-layer structure comprises an active region 116 located between two oppositely-doped epitaxial regions (114, 118). In this example, an n-type semiconductor region 114 is formed on the substrate 102 and a p-type semiconductor region 118 is formed on the active region 116. In other examples, the p-type semiconductor region 118 may be formed on the substrate 102 and the n-type semiconductor region 114 may formed on the active region 116. As those skilled in the art will readily appreciate, various concepts described throughout this disclosure may be extended to any suitable epitaxial-layer structure. Additional layers (not shown) may also be included in the epitaxial-layer structure, including buffer, nucleation, contact and current-spreading layers as well as light-extraction layers.

The electrodes 106, 108 may be formed on the surface of the epitaxial-layer structure. The p-type semiconductor region 118 is exposed at the top surface and, therefore, the p-type electrode 106 may be readily formed on the p-type semiconductor region 118. However, the n-type semiconductor region 114 is buried beneath the p-type semiconductor region 118 and the active region 116. Accordingly, to form the n-type electrode 108 on the n-type semiconductor region 114, a portion of the active region 116 and the p-type semiconductor region 118 is removed to expose the n-type semiconductor region 114. After this portion of the epitaxial-layer structure is removed, the n-type electrode 108 may be formed.

Figure 2:
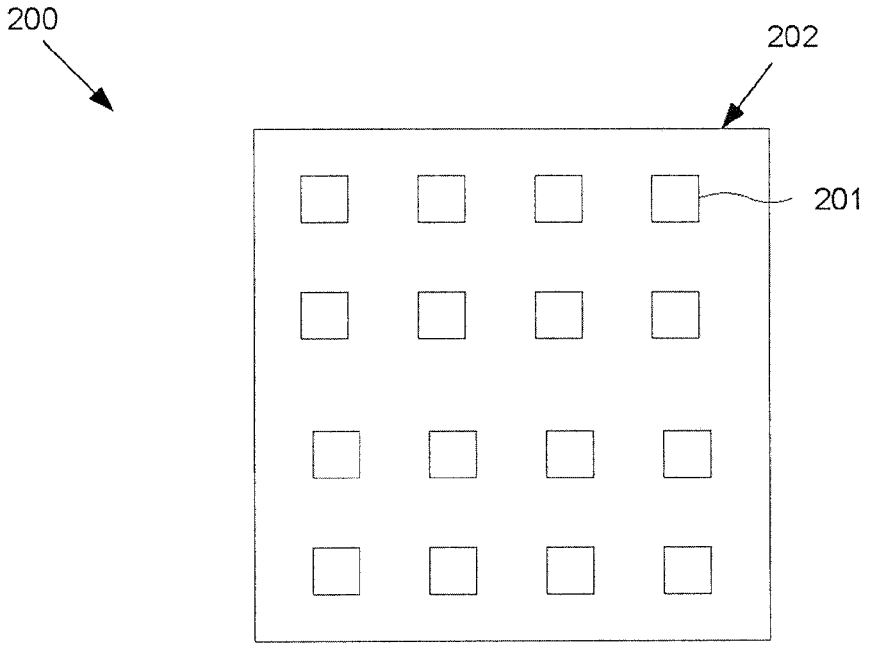
FIG. 2 is a plan-view illustration of the example light-emitting device.

One or more LEDs may be used to construct a light-emitting device. A light-emitting device having multiple LEDs disposed on a single substrate, as will be described in connection with FIG. 2, is sometimes referred to as an "LED array." However, the present disclosure is not limited to LED arrays, and may be extended to any suitable LED device or other suitable light source. FIG. 2 is a top-view illustration of an example light-emitting device 200. The light-emitting device 200 comprises multiple LEDs 201 arranged on a substrate 202. The substrate 202 may be made from any suitable material that provides mechanical support to the LEDs 201. Preferably, the material is thermally conductive to dissipate heat away from the LEDs 201. The substrate 202 may includes a dielectric layer (not shown) to provide electrical insulation between the LEDs 201. The LEDs 201 may be electrically-coupled in parallel or in series by a conductive circuit layer, wire bonding, or a combination of these or other methods on the dielectric layer (not shown).

The light-emitting device 200 may be configured to produce white light. White light may enable the LED device to act as a direct replacement for conventional light sources used today in incandescent, halogen, fluorescent, HID, and other suitable lights. There are at least two suitable ways of producing white light. One suitable way is to use individual LEDs that emit wavelengths (corresponding to certain colors, such as red, green, blue, or amber) and then mix all the colors to produce white light. Another suitable way is to use a phosphor material to convert monochromatic light emitted from a blue or ultra-violet (UV) LED to broad-spectrum white light. The present disclosure, however, may be practiced with other LED and phosphor combinations to produce different colored lights.

Figure 3A:
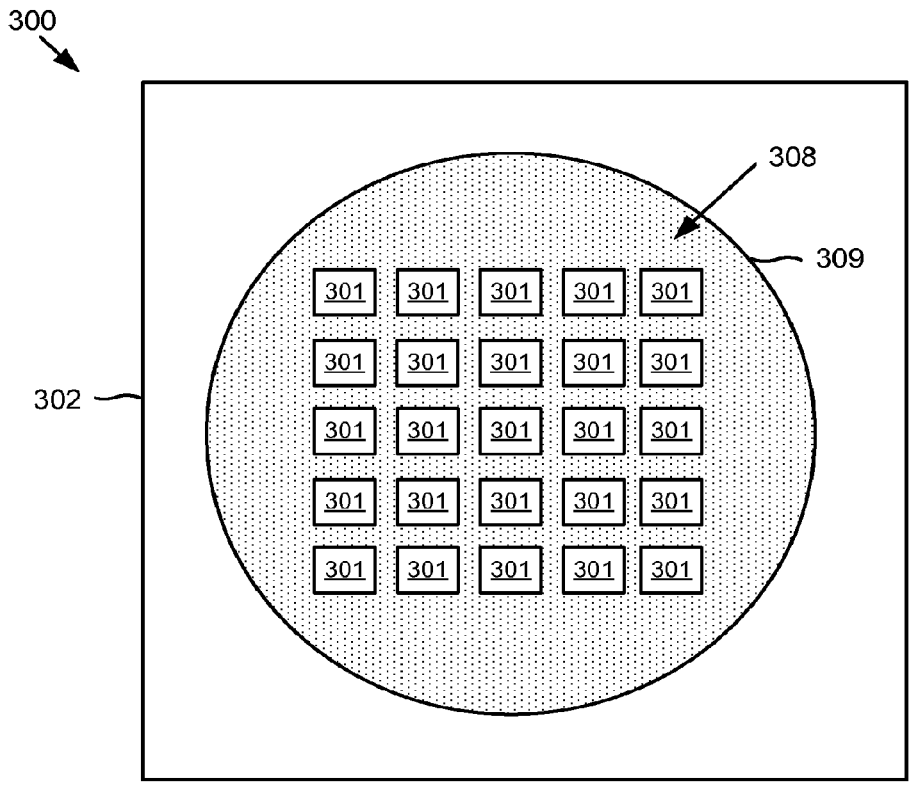
FIG. 3A is a top-view illustration of an example white-light light-emitting device.
Figure 3B:
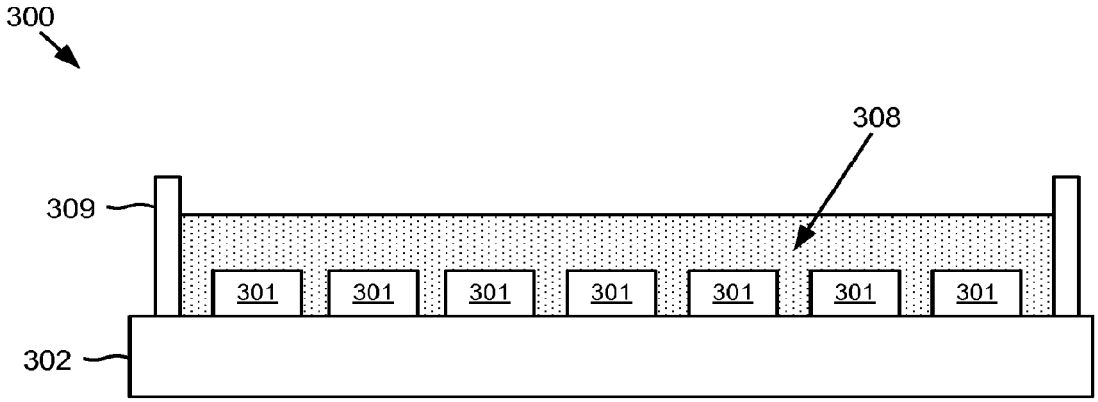
FIG. 3B is a side-view illustration of the example white-light light-emitting device illustrated in FIG. 3A.

FIG. 3A is a top-view illustration of an example white-light light-emitting device 300. FIG. 3B is a cross-sectional illustration of the example white-light light-emitting device 300 shown in FIG. 3A. The white-light light-emitting device 300 is shown with a substrate 302, which may be used to support multiple LEDs 301. A phosphor material 308 may be deposited within a cavity defined by an circular-shaped boundary 309 that extends circumferentially around the upper surface of the substrate 302. The circular-shaped boundary 309 may be formed with a suitable mold or, alternatively, formed separately from the substrate 302 and attached to the substrate 302 using an adhesive or other suitable means. The phosphor material 308 may include, by way of example, phosphor particles suspended in an epoxy, silicone, or other carrier, or may be constructed from a soluble phosphor that is dissolved in the carrier.

In another example, each LED 301 of a white-light light-emitting device 300 may have its own phosphor layer. Other configurations of LEDs 301 and other light-emitting cells may be used to create a white-light light-emitting device 300. The present disclosure is not limited to light-emitting devices that produce only white light and may be extended to lighting-emitting devices that produce other colors of light.

Street lights may be designed to provide improved visibility and increased safety on a roadway while making efficient use of energy. A street light provides illumination in a particular light distribution pattern. The Illumination Engineering Society (IES) has established a series of lateral distribution patterns, which are designated as Types I, II, III, IV, and V. High-intensity discharge (HID) lights may be used in street lights. LEDs may replace HID lights.

Figure 4:
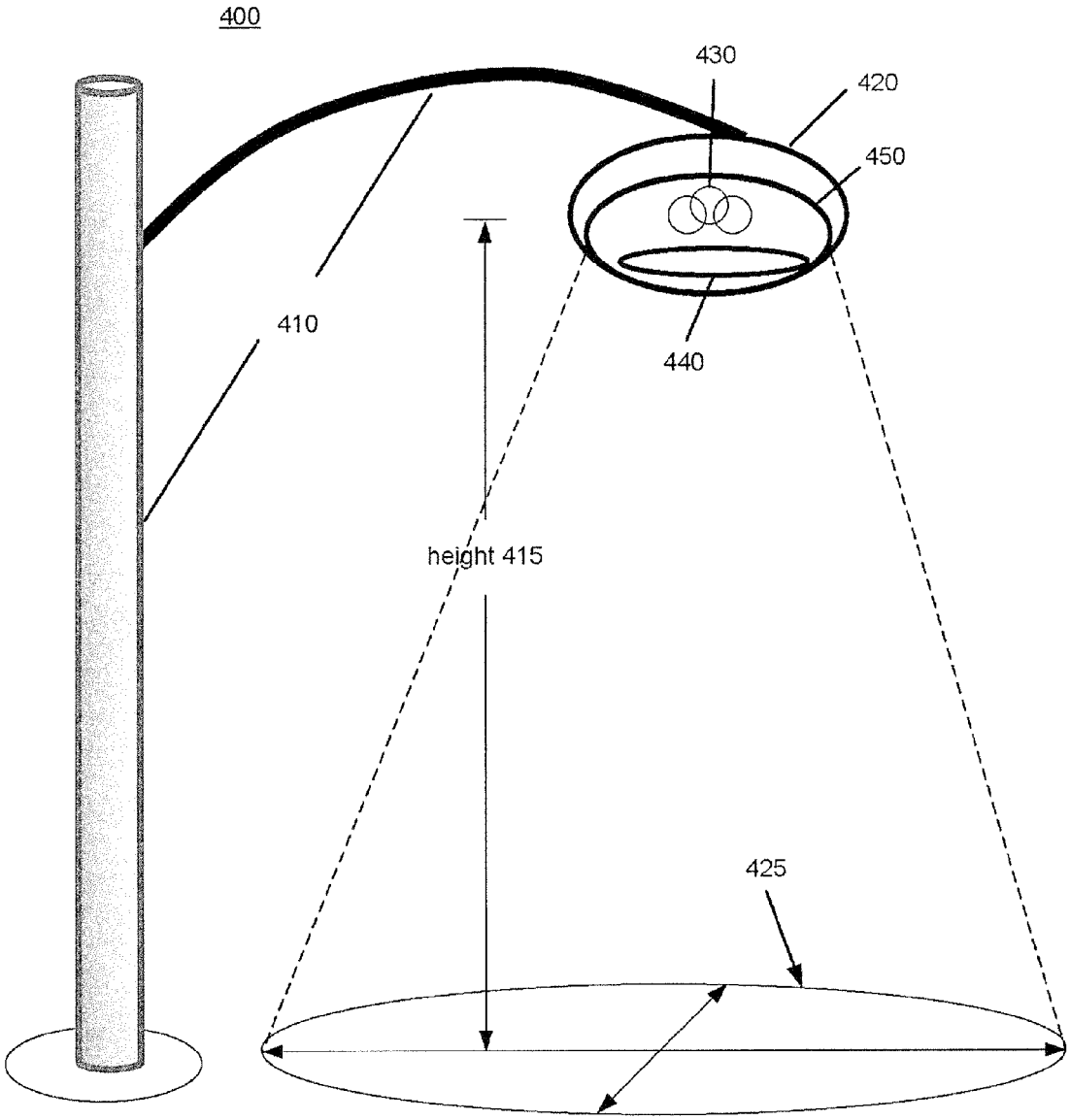
FIG. 4 is an illustration of exemplary light-emitting devices in a street light.

FIG. 4 is an illustration of exemplary light-emitting devices in a street light 400. The street light 400 may include a pole 410 and a head 420 attached to the pole 410. The head 420 may include a light source that includes one or more light-emitting devices 430, an optical element 440, and a reflector 450 of the head 420. The reflector 450 may be configured to reflect light emitted by the light-emitting devices 430 to the optical element 440 to produce a light distribution pattern 425.

In some embodiments, the light emitted from the light-emitting devices 430 may be Lambertian patterned light. The Lambertian patterned light may be used to illuminate a reflector 450 and/or may be directed to optical element 440. Optical element 440 may be used to transform the Lambertian patterned light and/or internally reflected light to produce a desired light distribution pattern 425.

Optical element 440 may comprise one or more mirrors, lenses and other elements that may be configurable to accommodate various heights 415 of the street light 400, light distribution patterns 425, illumination intensities, and/or size of the light-emitting device 430.

In certain embodiments, systems, apparatus and methods are provided to facilitate rapid and/or easy replacement of a lighting module in a street light or other lighting device. A lighting module may comprise one or more light-emitting devices 430 and an optical component that diffuses, collimates, focuses or otherwise modulates light to obtain a desired light distribution pattern 425.

Figure 5:
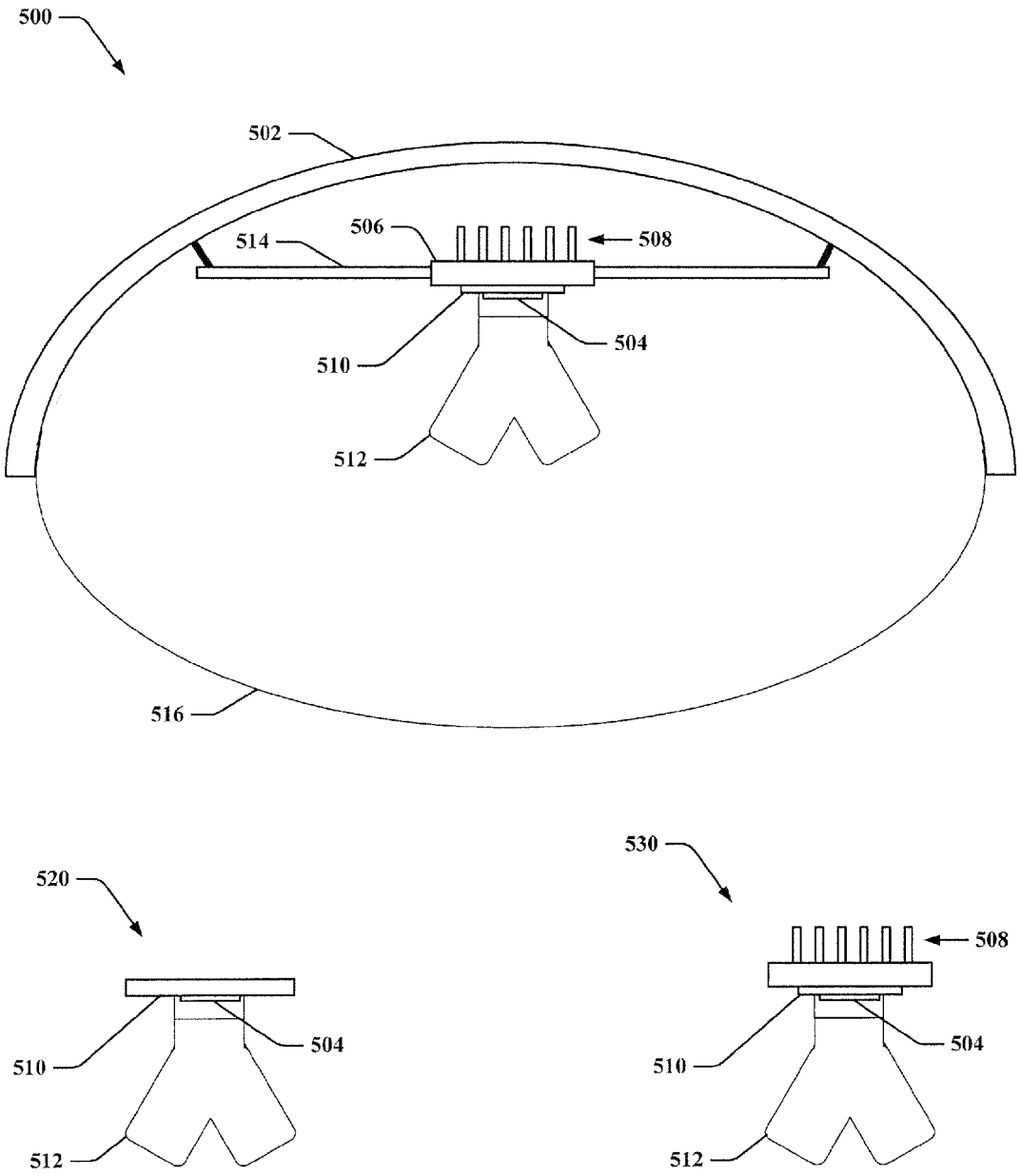
FIG. 5 is a cross-sectional illustration of a first example head of a lighting system.

FIG. 5 is a cross-sectional illustration of a first example head 502 of a lighting system 500. The lighting system 500 may comprise a lighting module 520, 530 and a base plate 514. The lighting module 520, 530 may comprise one or more LED arrays 504, a thermal interface 510, a heat sink 506 and an optical element 512. In one example, the lighting module 520, 530 comprises each of the LED arrays 504, the thermal interface 510, the heat sink 506, and the optical element 512. In another example, the lighting module 520, 530 comprises LED array 504, thermal interface 510 and, optionally, optical element 512. The thermal interface 510 may assist in dissipating heat generated by the LED array 504. The lighting module 520, 530 may be used in association with the heat sink 506.

In some embodiments, the thermal interface 510 may be characterized by low thermal resistance and high electrical resistance. Thermal interface 510 may be multilayered. For example, the thermal interface 510 may include a relatively thin electrical isolation layer that is bonded to a surface of the thermal interface 510. An electrical isolation layer may be created through an oxidation of a surface of the LED array 504 and/or the heat sink 506. In some embodiments, electrical isolation is not desired or required and the heat sink 506 may provide a portion of an electrical circuit that includes the LED array 504. For example, the heat sink 506 may provide a grounding connection for the lighting module 520, 530.

The lighting module 520, 530 may be fitted into a base plate 514 mounted within the head 502. Base plate 514 may be constructed from a metal, polymer, ceramic, a composite or other material having sufficient tensile strength to support the lighting module 520, 530 and a relatively heavy heat sink 506. Base plate 514 may be configured to adapt head 502 for use with the lighting module 520, 530, thereby replacing incandescent, fluorescent or HID lights with an array 504 of light-emitting devices. For example, the base plate 514 may be used to adapt a head 502 that is otherwise configured for use with an HID light. Base plate 514 may be adapted by, for example, providing holes, threads or other elements configured to receive one or more fasteners used to attach base plate to the head 502. In some embodiments, the base plate 514 may comprise an adapted or original base plate 514 that is used to attach HID or another type of light to the head 502. The base plate 514 may attach directly to the heat sink 506, which may attach to the LED arrays 504, thermal interface 510, and/or optical element 512. The heat sink 506 may comprise fins 508 to increase surface area exposed to air in order to permit rapid dissipation of heat generated by the LED array 504. The heat sink 506 may be constructed from a low-thermal resistance material, and the heat sink 506 may have sufficient volume and density to absorb cyclic variations in heat generation.

The optical element 512 typically comprises one or more lenses, mirrors, reflectors and/or prisms that receive light from the LED array 504 and that produce one or more light distribution patterns 425 (see FIG. 4). The optical element 512 may be mechanically adjustable to re-size and/or re-orient light distribution patterns 425 (see FIG. 4) based on a specific application of the lighting system 500. For example, the relative distances of certain optical components within an optical module can be adjusted with respect to one another and/or with respect to the LED array 504. The optical element 512 may include elements that diffract, diffuse, focus, defocus, collimate, polarize, depolarize, and/or attenuate light or frequencies of light received from the LED array 504. A lens 516 may provide further light correction and/or manipulation. In some embodiments, the lens 516 may be a transparent, optically-neutral cover that serves to protect lighting module and other components within the head 502 from environmental conditions.

Figure 6:
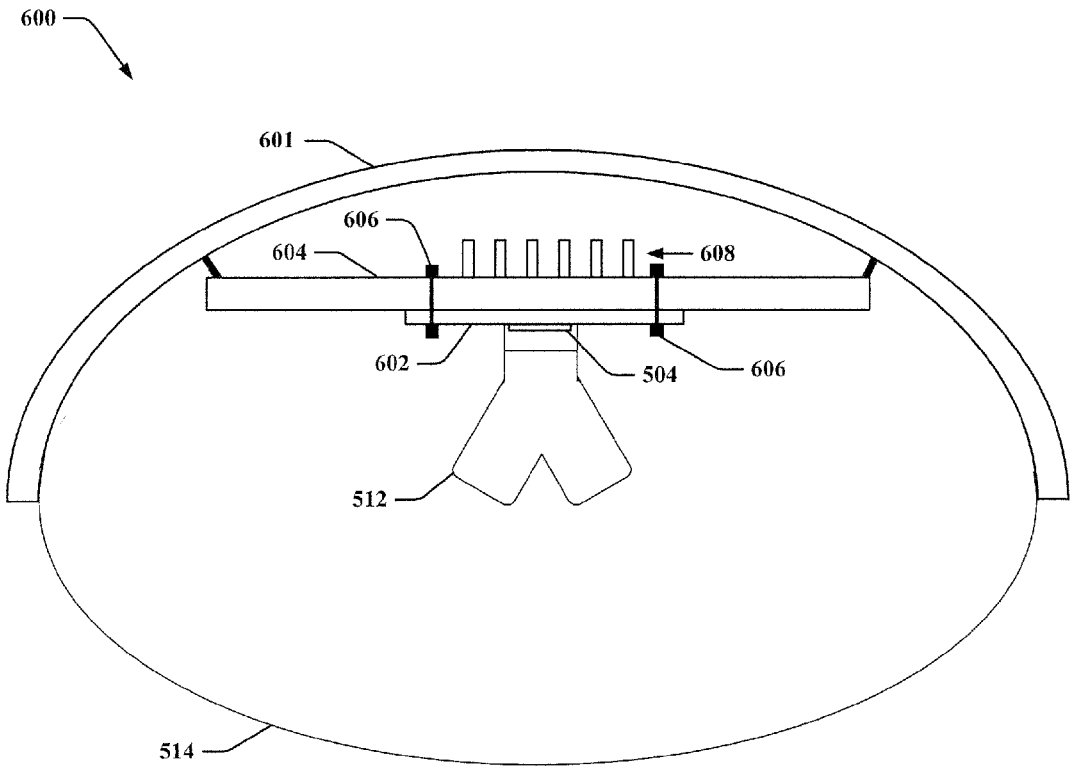
FIG. 6 is a cross-sectional illustration of a second example head of a lighting system.

FIG. 6 is a cross-sectional illustration of a second example head 601 of a lighting system 600. The lighting system 600 may comprise a lighting module 520, 530 (see FIG. 5) and a base plate 604. The lighting module 520, 530 (see FIG. 5) may comprise a LED array 504, a thermal interface 602, and/or an optical element 512. In one example, the lighting module 520, 530 (see FIG. 5) comprises each of the LED array 504, the thermal interface 602, and the optical element 512. The lighting module 520, 530 (see FIG. 5) may be removably attached to a base plate 604 that is attached to the head 502.

In one example, the base plate 604 is constructed to operate as a heat sink and may comprise heat dissipating elements, such as one or more fins 608. The lighting module 520, 530 (see FIG. 5) may be attached to the base plate 604 using fasteners 606 that, for example, couple the thermal interface 602 and the base plate 604. Fasteners may comprise screws, bolts, pins, rivets, or other suitable fasteners. In some embodiments, threaded surfaces provided on the thermal interface 602 and the base plate 604 may be used to fasten the lighting module 520, 530 (see FIG. 5) to the base plate 604.

The thermal interface 602 may be constructed as a plate of any suitable shape and with a thickness to provide sufficient mechanical strength to support lighting module. In particular, the thermal interface 602 may provide one or more fasteners and/or threaded surfaces (not shown) to engage and support the optical element 512. The thermal interface 602 may be constructed from any suitable material that provides desired thermal and electrical conductivities.

A self-contained lighting module 520, 530 (see FIG. 5) comprising the LED array 504, the thermal interface 510, the optical element 512, and their corresponding electrical connections may alternatively be used. For example, a failed or failing lighting module 520, 530 (see FIG. 5) may be replaced without removing the head 502 from the street light 400 (see FIG. 4).

Figure 7:
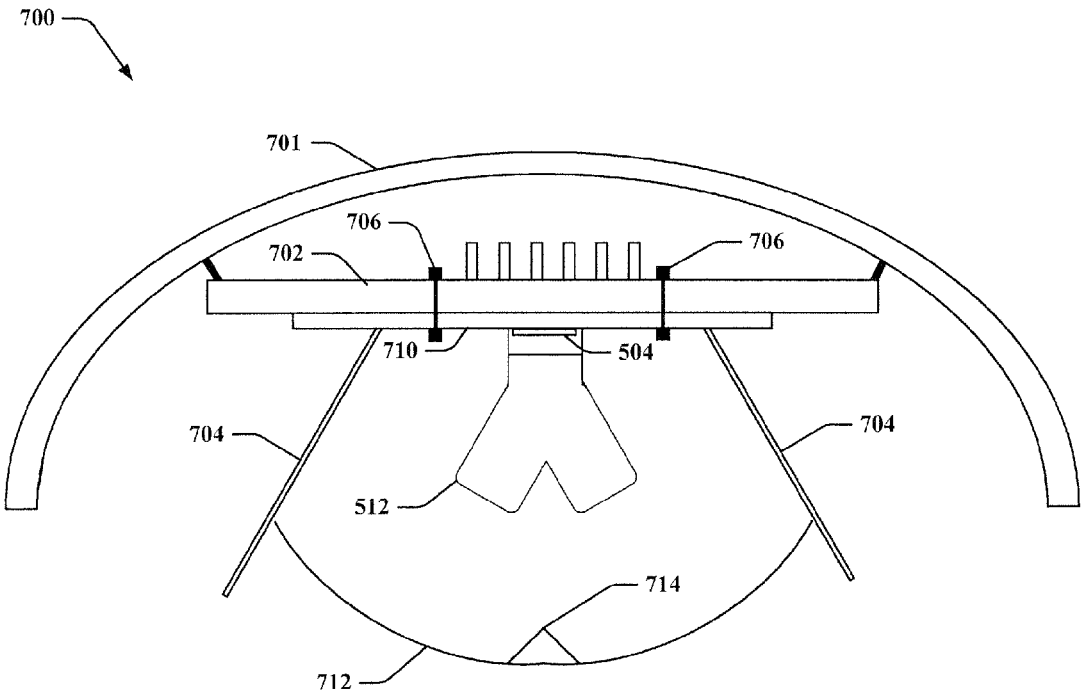
FIG. 7 is a cross-sectional illustration of a third example head of a lighting system.

FIG. 7 is a cross-sectional illustration of a third example head 701 of a lighting system 700. The lighting system 700 may comprise certain features and elements described in relation to FIGS. 5 and 6. The lighting system 700 may include one or more additional reflectors 704 mounted on an outer part of the lighting module 520, 530 (see FIG. 5) or external to the lighting module 520, 530 (see FIG. 5). In certain embodiments, the reflectors 704 may be provided as an integral part of the lighting module 520, 530 (see FIG. 5). As shown in the example of FIG. 7, one or more reflectors 704 may be attached to the thermal interface 710.

In one example, the one or more reflectors 704 have a frustoconical shape that is aligned concentrically with the center of the LED array 504. In another example, the one or more reflectors 704 may comprise a plurality of reflective segments corresponding to segments of a frustum of a cone. The one or more of reflectors 704 may comprise a generally flat, parabolic or irregularly-shaped surface. The one or more reflectors 704 may modify a light distribution pattern 425 (see FIG. 4). The one or more reflectors 704 may operate to deflect light from a particular area of the light distribution pattern 425 (see FIG. 4). The one or more reflectors 704 may operate to recover light that would otherwise leak from the lighting module 520, 530 (see FIG. 5), such as from the optical element 512 and/or the LED array 504. The one or more reflectors 704 may operate to shade a neighboring structure from an otherwise broad light pattern. The one or more reflectors 704 may be constructed from any suitable material, including polished metals, and/or polymers, glass, ceramics or other material treated or manufactured to have a reflective surface.

In some embodiments, the one or more reflectors 704 may be adapted to provide a light absorbing surface. In some embodiments, the one or more reflectors 704 are provided as reflective areas of a frustoconical protective screen that may be clear or opaque in areas that are not reflective. A dome or flattened lens 712 may be provided to complete the protective outer shell. The lens 712 may optically transform light passing through it, or the lens 712 may conduct light with minimum diffraction and/or attenuation. The lens 712 may comprise an optical block 714 that reduces the occurrence of hotspots and other artifacts in the light distribution pattern 425 (see FIG. 4) by dispersing a portion of the light transmitted by optical element 512.

Figure 8:
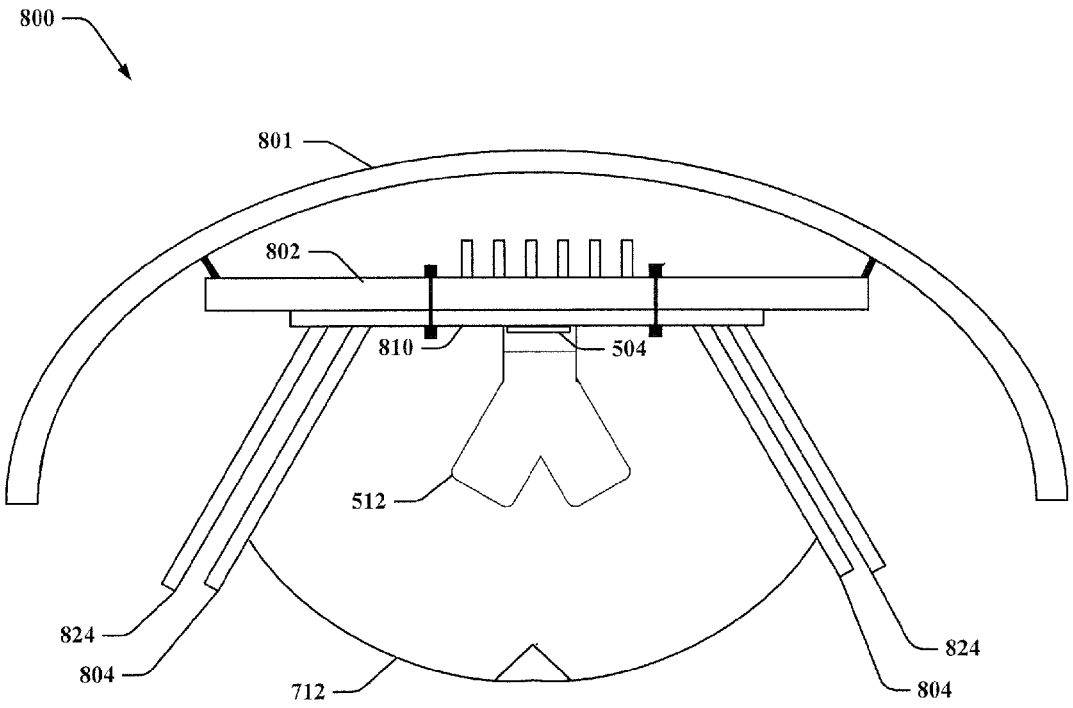
FIG. 8 is a cross-sectional illustration of a fourth example head of a lighting system.

FIG. 8 is a cross-sectional illustration of a fourth example head 801 of a lighting system 800. The lighting system 800 may comprise certain features and elements described in relation to FIGS. 5-7. The lighting system 800 may comprise one or more reflectors 804. Some of the one or more reflectors 804 may have multiple functions. For example, one or more of the reflectors 804 may serve to dissipate heat generated by the LED array 504. One or more concentric layers of fins 824 may surround the one or more reflectors 804. The one or more concentric layers of fins 824 may operate to dissipate heat generated by the LED array 504. The one or more reflectors 804 may be arranged with the lens 712 in a manner that encloses the lighting module 520, 530 (see FIG. 5). The thermal interface 810 may be increased in volume and area in order to provide heat-sinking capacity directly to one or more lighting modules 520, 530 (see FIG. 5). The one or more reflectors 804 and/or one or more concentric layers of fins 824 may be thermally coupled to the thermal interface 810 and may assist in dissipating heat generated by the LED array 504. Accordingly, the one or more reflectors 804 and the one or more concentric layers of fins 824 may be constructed from a thermally-conductive material in order to enable efficient dissipation of heat generated by the LED array 504.

In some embodiments, the heat sink 802 may be replaced by an adaptor plate (not shown) that attaches the lighting module 520, 530 (see FIG. 5) to the head 801. Accordingly, the plate 802 may primarily perform mechanical mounting services, and the one or more concentric layers of fins 824 being eliminated. In some embodiments, the plate 802 may be reduced in size to perform less heat-sinking and the one or more concentric layers of fins 824 may be reduced in size or eliminated.

Figure 9:
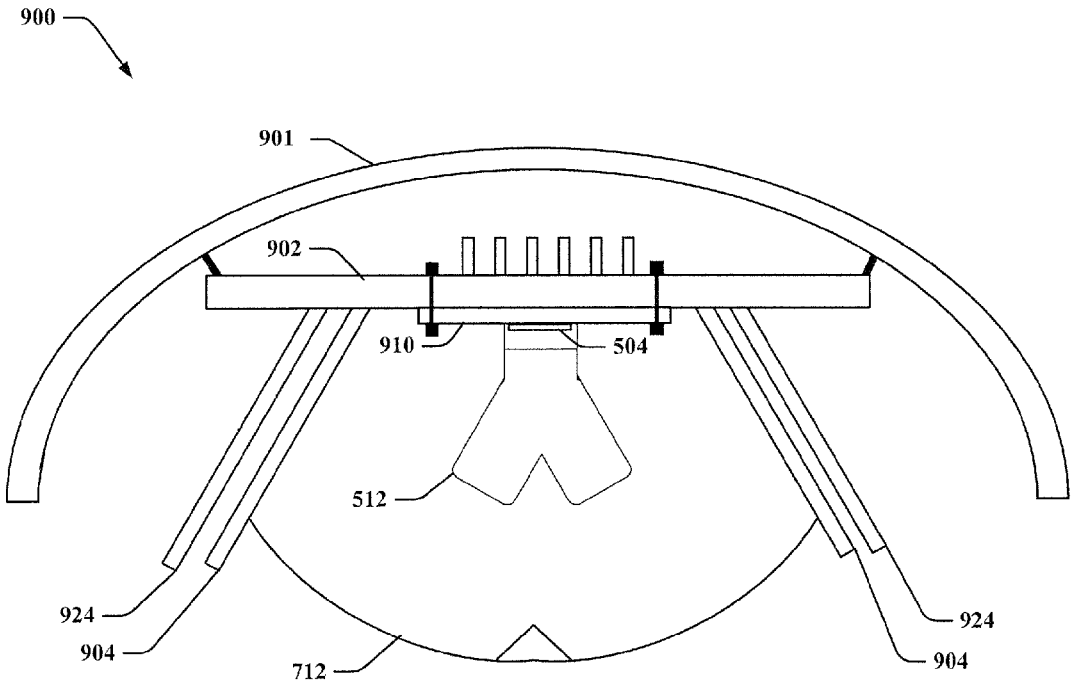
FIG. 9 is a cross-sectional illustration of a fifth example head of a lighting system.

FIG. 9 is a cross-sectional illustration of a fifth example head 901 of a lighting system 900. The lighting system 900 generally comprises certain features and elements of the lighting system previously described in relation to FIGS. 5-8. The lighting system 900 includes one or more reflectors 904, provided externally to the lighting module 520, 530 (see FIG. 5). The one or more reflectors 904 may perform multiple functions and may include one or more layers of fins 924 concentrically aligned with the one or more reflectors 904 and the LED array 504. The one or more concentric later of fins 924 may be attached to base plate 902 with low thermal resistance, and the one more concentric layers of fins 924 may serve as heat-sinking fins. The innermost of the one or more concentric layer of fins 904 may comprise a reflective surface that faces towards a lighting module 520, 530 (see FIG. 5) and may operate to selectively reflect and/or absorb light leaked or emitted by the optical element 512 and/or LED array 504.

The one or more reflectors 904 or one or more concentric layers of fins 924 may attach to an optional lens 712 that encloses the lighting module 520, 530 (see FIG. 5). The thermal interface 910 may fasten the lighting module 520, 530 (see FIG. 5) to the base plate 902, which performs as the principal heat sink for array 504. Reflective elements 904 and one or more concentric layers of fins 924 may be attached to the base plate 902, and may be constructed from a thermally-conductive material to dissipate heat generated by the LED array 504. In some embodiments, the one or more reflectors 904, the one or more concentric layers of fins 924, and the base plate 902 may be constructed or cast as a single element.

Figure 10:
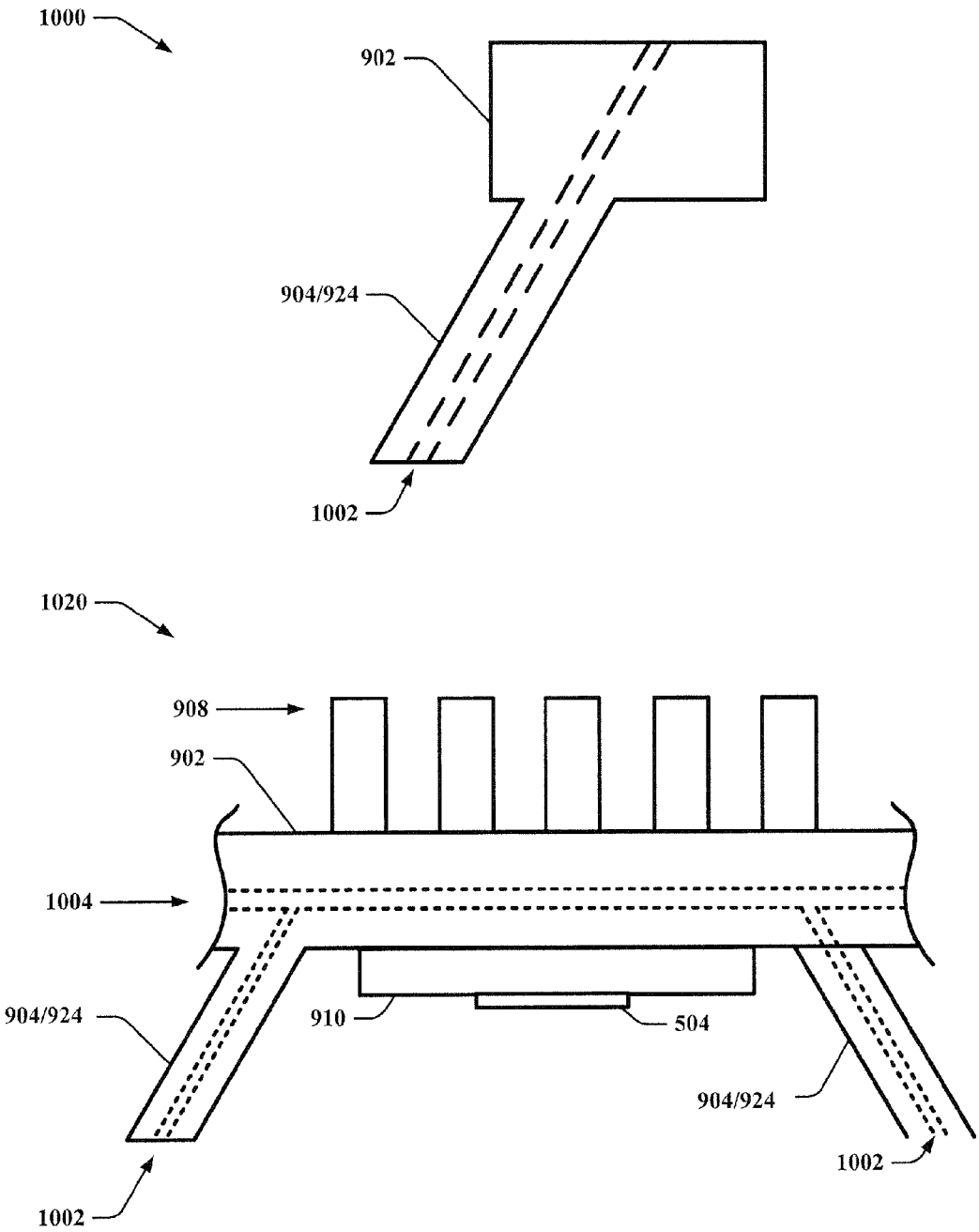
FIG. 10 shows cross-sectional illustrations of portions of an exemplary lighting module.

FIG. 10 are cross-sectional illustrations of portions of an exemplary lighting module. In one example 1000, the reflector/fin 904/924 may have one or more thermal chimneys formed from passage 1002. A thermal chimney, comprising passage 1002, is provided within the body of the reflector/fin 904/924 and extends along the length of the reflector/fin 904/924 and through the base plate 902. As the base plate 902 and the reflector/fin 904/924 are heated, air within the passage 1002 is heated and rises (due to convection). As the heated air in the passage 1002 rises, cooler air is drawn into the passage 1002, thereby increasing the effectiveness of the heat sink (i.e., the base plate 902 and the reflector/fin 904/924).

In another example 1020, a passage 1004 connects to one or more passages 1002 provided in reflectors/fins 904/924. The one or more passages 1002 may form a heat pipe capable of efficiently transporting heat throughout the base plate 902 and the reflectors/fins 904/924. Convection airflow through the heat pipe formed by passages 1002, 1004 may transfer heat between the base plate 902 and the reflectors/fins 904/924.

The one or more reflectors 804, 904 (see FIGS. 8 and 9) may have a reflective surface on at least one surface of the innermost reflector. The reflective surface may be located and configured to redirect a portion of the light emanating from the light-emitting array 504 or the optical element 512. The reflective surface may redirect a portion of the light emitted from the one or more light-emitting devices 504 away from an area adjacent to the lighting module 520, 530 (see FIG. 5). The reflective surface may redirect a portion of the light transmitted by the optical element to modify the light distribution pattern 425 (see FIG. 4). The reflective surface may increase or decrease light transmitted to a portion of the light distribution pattern 425 (see FIG. 4). The reflective surface may increase, decrease, or otherwise modify the coverage area of the light distribution pattern 425 (see FIG. 4).

The fins 804, 824 (see FIG. 8) and/or 904, 924 (see FIG. 9) may have a shape that is frustoconical, where one end has a greater diameter than the other end, and the end defined by the larger radius/diameter may mount a protective lens 712 (see FIG. 9). The protective lens 712 (see FIG. 9) may protect the LED array 504, the reflective surface, and/or the optical element 512 from environmental conditions and contaminants. The end comprising the smaller radius/diameter may be attached to thermal interface 810 (see FIG. 8). The end comprising the smaller radius/diameter may be attached to heat sink 902 (see FIG. 9).

The various aspects of a street light are provided to enable one of ordinary skill in the art to practice the present disclosure. Various modifications to, and alternative configurations of, the street light presented throughout this disclosure will be readily apparent to those skilled in the art, and the concepts disclosed herein may be extended to other lighting applications. Thus, the claims are not intended to be limited to the various aspects of a street light presented throughout this disclosure, but are to be accorded the full scope consistent with the language of the claims. Thus, for example, lighting fixtures of any type, and for any lighting purpose, may be configured in accordance with the disclosure. All structural and functional equivalents to the elements of the various aspects of a light source described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

What is claimed is:

1. A lighting module, comprising:

a light-emitting device configured to emit light;

a thermal interface configured to conduct heat away from the light-emitting device;

an optical element configured to transmit the emitted light in a light distribution pattern on an area located a distance away from the lighting module;

first and second fins disposed in concentric alignment with the light-emitting device, wherein the second fin surrounds the first fin, and wherein the second fin is configured to dissipate heat generated by the light-emitting device; and a reflective surface configured to redirect a portion of the light transmitted by the optical element, wherein the reflective surface is provided on an inner surface of the first fin.

2. The lighting module of claim 1, wherein the reflective surface is further configured to redirect a portion of the light emitted by the light-emitting device.

3. The lighting module of claim 1, wherein the portion of transmitted light redirected by the reflective surface modifies the light distribution pattern.

4. The lighting module of claim 1, wherein the reflective surface is further configured to increase an amount of light transmitted to a portion of the light distribution pattern.

5. The lighting module of claim 1, wherein the reflective surface is further configured to decrease an amount of light transmitted to a portion of the light distribution pattern.

6. The lighting module of claim 1, wherein the reflective surface is further configured to modify a coverage area of the light distribution pattern.

7. The lighting module of claim 1, wherein at least one of the first and second fins is thermally coupled to the thermal interface.

8. The lighting module of claim 7, wherein the at least one of the first and second fins is also thermally coupled to a heat sink.

9. The lighting module of claim 8, wherein the at least one of the first and second fins comprises a first passage that is configured to allow an airflow through the at least one of the first and second fins.

10. The lighting module of claim 9, wherein the first passage is connected to a second passage that is configured to allow an airflow through the thermal interface.

11. The lighting module of claim 9, wherein the first passage is connected to a third passage that is configured to allow an airflow through a heat sink.

12. The lighting module of claim 11, wherein the thermal interface is thermally coupled to the heat sink.

13. The lighting module of claim 8, wherein the first fin has a frustoconical shape, a first end corresponding to a first radius, and a second end corresponding to a second radius, and wherein the first radius is smaller than the second radius.

14. The lighting module of claim 13, further comprising a lens attached at the second end, wherein the lens is configured to protect the light-emitting device and the optical element from environmental conditions.

15. The lighting module of claim 13, wherein the first end is attached to the thermal interface.

16. The lighting module of claim 13, wherein the first end is attached to the heat sink.

17. The lighting module of claim 16, wherein the thermal interface is further configured to be removably fastened to the heat sink.

18. The lighting module of claim 16, wherein the heat sink is mounted in a head of a street light.

19. The lighting module of claim 1, wherein the light-emitting device comprises a plurality of light-emitting diodes.

* * * * *